United States Patent [19]

Nomoto

[11] Patent Number: 5,007,391

[45] Date of Patent: Apr. 16, 1991

[54] ENGINE START FACILITATING VALVE

[75] Inventor: Shigeki Nomoto, Tokyo, Japan

[73] Assignee: Komatsu Zenoah Company, Tokyo, Japan

[21] Appl. No.: 414,900

[22] Filed: Sep. 29, 1989

[30] Foreign Application Priority Data

Sep. 30, 1988 [JP] Japan ..... 63-127392[U]
Jul. 31, 1989 [JP] Japan ..... 1-90209[U]

[51] Int. Cl.[5] ..... F02N 17/00
[52] U.S. Cl. ..... 123/182; 417/299
[58] Field of Search ..... 123/182; 417/299; 137/614.2, 505.35

[56] References Cited

U.S. PATENT DOCUMENTS

| | | | |
|---|---|---|---|
| 854,035 | 5/1907 | Hansen-Ellehammer | 123/182 |
| 1,254,104 | 1/1918 | Wygodsky | 123/182 |
| 3,335,711 | 8/1967 | Roorda | 123/182 |
| 3,704,988 | 12/1972 | Steele | 123/182 |
| 3,782,354 | 1/1974 | Tuckey | 123/182 |
| 3,893,440 | 7/1975 | Dooley | 123/182 |
| 4,414,933 | 11/1983 | Pribnow | 123/182 |

FOREIGN PATENT DOCUMENTS

| | | | |
|---|---|---|---|
| 0024871 | 3/1981 | European Pat. Off. . | |
| 188464 | 9/1907 | Fed. Rep. of Germany . | |
| 417854 | 11/1910 | France | 123/182 |
| WO85/02893 | 7/1985 | PCT Int'l Appl. . | |

*Primary Examiner*—Andrew M. Dolinar
*Attorney, Agent, or Firm*—Marger, Johnson, McCollom & Stolowitz

[57] ABSTRACT

To facilitate start of a 2-cycle engine, for instance, compression pressure at the first compression stroke is released through the valve to reduce reaction force applied to an engine starter; once the mixture is ignited, explosion pressure at the first explosion stroke and after is accumulated in the accumulator space through the check valve member to keep the valve member closed against the valve spring, so that the engine is operated under the ordinary conditions; when the engine is at halt, accumulator pressure is released through the openable check valve member and the valve member opened by the valve spring to its original conditions.

10 Claims, 2 Drawing Sheets

ENGINE START FACILITATING VALVE

BACKGROUND OF THE INVENTION

1. Field of the Invention

The present invention relates to an engine start facilitating valve, and more specifically a valve for facilitating start of a two-cycle engine started by a recoil starter or a small starting motor.

2. Description of the Prior Art

Conventionally, a small two-cycle (e.g. single cylinder) engine is started by use of a mechanical recoil starter or a small starting motor. At engine start, however, since a reaction force due to cylinder pressure developed at piston compression stroke is applied to the recoil starter or the starting motor in addition to engine starting force, there exists a problem in that a large engine starting power is inevitably required for two-cycle engine start, and therefore the size of the recoil starter or the starting motor inevitably increases.

SUMMARY OF THE INVENTION

With these problems in mind, therefore, it is the primary object of the present invention to provide an engine start facilitating valve for allowing a two-cycle engine to be started by means of a small-sized recoil starter or starting motor.

To achieve the above-mentioned object, an engine start facilitating valve, according to the present invention comprises: (a) a valve housing (11) attached to the engine; (b) spacer member (16) disposed within said valve housing and formed with at least one accumulator space for accumulating engine explosion pressure; (c) a check valve member (14) disposed within said valve housing, for opening/closing communication between an engine combustion chamber and the accumulator space; (d) a valve member (15) disposed within said valve housing, for opening/closing communication between the accumulator space and the atmospheric pressure; (e) a valve rod (12) for elastically urging said valve member to open condition by a valve spring, at engine compression stroke cylinder pressure being released to atmospheric pressure through said opened check valve member and said opened valve member, at engine explosion stroke and after, cylinder pressure being accumulated in the accumulator space to close said valve member against the valve spring, at engine halt accumulated pressure being released through both said check valve member and said valve member.

The spacer member (16) is a triangular in shape and three accumulator spaces (**16*a*) are formed between three end surfaces of the spacer member and an inner wall of the valve housing. Further, since the valve rod (12) is formed with a valve head (12*b*), when the valve member (15**) sticks to a valve seat, the valve member is readily released open when the valve head is pushed by the hand.

In the engine start facilitating valve according to the present invention, since pressure within the engine cylinder and applied to the recoil starter or the starting motor can be released open at the first engine compression stroke to reduce the compression pressure, it is possible to facilitate engine start. After the engine has been started, since pressure generated within the engine cylinder at explosion stroke is accumulated in the accumulator space to keep the valve closed against the elastic force of the valve spring, the engine can be operated under the ordinary conditions. Further, at engine halt, the accumulated pressure is released through the valve.

BRIEF DESCRIPTION OF THE DRAWINGS

The features and advantages of the engine start facilitating valve according to the present invention will be more clearly appreciated from the following description taken in conjunction with the accompanying drawings in which like reference numerals designate corresponding elements and in which.

DETAILED DESCRIPTION OF THE PREFERRED EMBODIMENT

Figure 1:
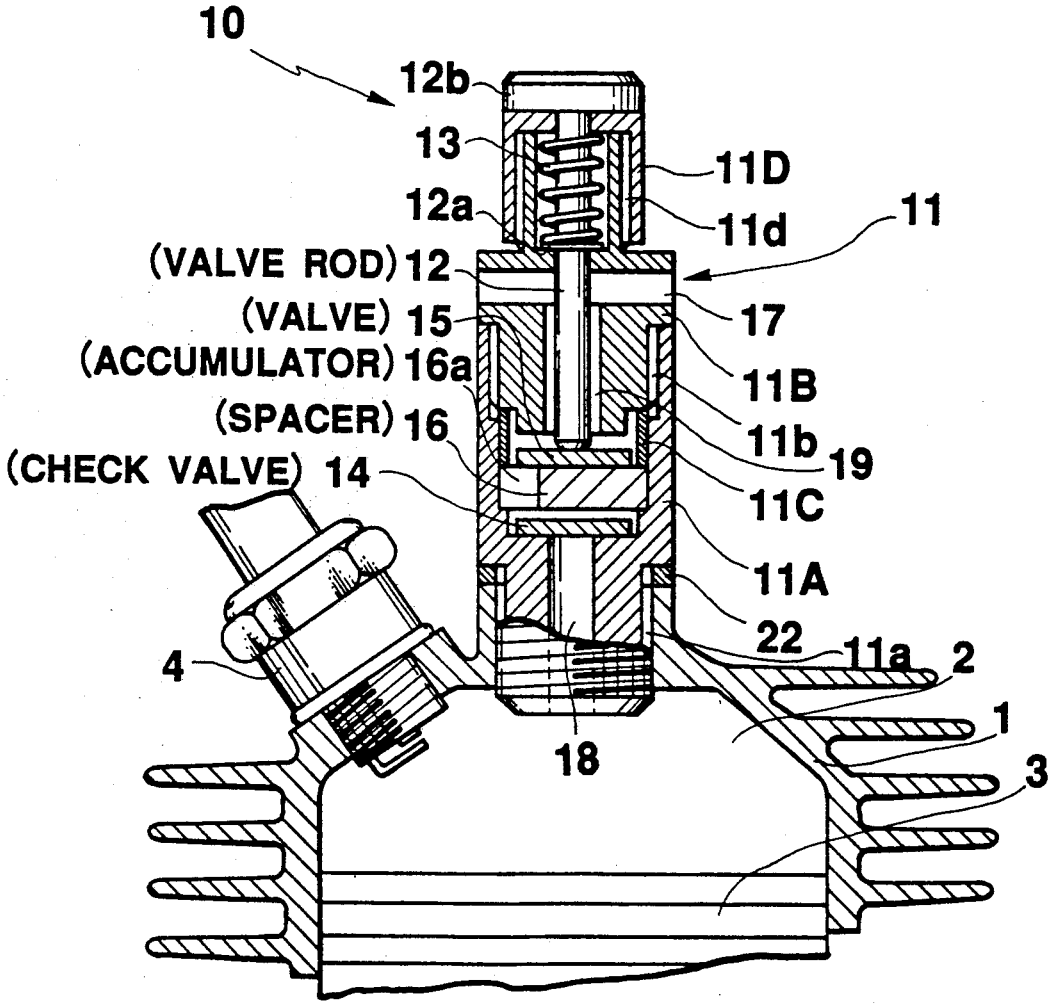
FIG. 1 is a longitudinal cross-sectional view showing an embodiment of the engine start facilitating valve according to the present invention, which illustrates a state before engine start.

An embodiment of the engine start facilitating valve according to the present invention will be described in detail hereinbelow with reference to the attached drawings:

In FIG. 1 an engine cylinder 1 is formed with a combustion chamber 2, and a piston 3 is fitted to the combustion chamber 2 so as to be movable therein reciprocably. To the top head of the engine cylinder 1, an ignition plug 4 and an engine start facilitating valve 10 according to the present invention are fixed by screwing threaded portions thereof into threaded holes formed on the cylinder head.

The engine start facilitating valve 10 comprises a valve housing 11, a valve rod 12, a valve spring 13, a cylindrical check valve member 14, a cylindrical valve member 15, and a triangular spacer member 16.

The valve housing 11 is composed of a main valve housing 11A fixed to the cylinder head at a threaded portion **11*a* thereof with a washer 22 interposed therebetween, a valve rod support housing 11B fixed to the main valve housing 11A at a threaded portion 11*b* thereof with the triangular spacer 16 and a spacer support member 11*c* interposed therebetween, and a cap housing 11D fixed to the valve rod support housing 11B at a threaded portion 11*d*** thereof.

The main valve housing 11A is formed with a central hollow portion 18 and three different diameter shoulder portions. The central hollow portion 18 communicates with the combustion chamber 2. The cylindrical check valve member 14 is disposed at the smallest inner diameter shoulder portion; the triangular spacer member 16, the cylindrical valve member 15, and the spacer support member **11*c* are disposed at the medium inner diameter shoulder portion; and the valve rod support housing 11B** is screwed into the largest inner diameter shoulder portion.

The valve rod support housing 11B is formed with a central longitudinal hollow portion 19 through which the valve rod 12 is loosely fitted and a radial passage 17 open to the atmospheric pressure.

In this specification, the radial passage 17 formed in the valve rod support housing 11B is called a first passage; the axial passage 18 formed in the main valve housing 11A is called a second passage; and the space formed between the main valve housing 11A and the valve rod support housing 11B and the axial passage 19 formed in the valve rod support housing 11B is called a third passage.

The valve rod 12 is formed with a flange portion 12*a* and a head portion 12*b*. The valve spring 13 is disposed between the flange portion 12*a* of the valve rod 12 and the inner top surface of the cap housing 11D.

Figure 3:
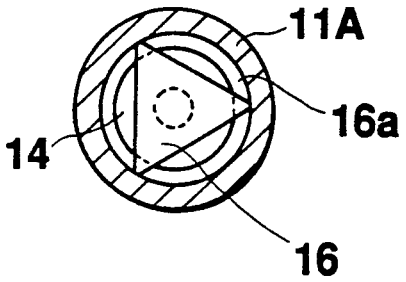
FIG. 3 is a cross-sectional view taken along the line III—III in FIG. 2.

Further, since the triangular spacer member 16 is fitted to the medium inner diameter shoulder portion, three accumulator spaces 16*a* are formed between the outer side surfaces of the spacer member 16 and the inner wall of the main valve housing 11A, as shown in FIG. 3. Further, the check valve member 14 is radially and axially loosely fitted to the smallest inner diameter shoulder portion of the main valve housing 11A, and the valve member 15 is also radially and axially loosely fitted between the triangular spacer member 16 and the valve rod support housing 11B, being usually urged against the spacer member 16 by the valve rod 12 biased by the valve spring 13.

Therefore, the accumulator space 16*a* communicates with the combustion chamber 2 via the check valve member 14 and the second passage 18, and further with the atmospheric pressure via the valve member 15 and the third passage 19 and the radial passage 17 formed in the valve rod support housing 11B.

The operation of the engine start facilitating valve according to the present invention will be described hereinbelow.

Before the engine is started, the valve is in the state as shown in FIG. 1. Under these conditions, when the engine is started by a recoil starter (now shown) or a stating motor, since the valve member 15 is kept open by the valve rod 12 urged by the valve spring 13, a mixture introduced into the engine cylinder 1 and compressed by the piston 3 is partially released to the atmosphere via the check valve member 14, the accumulator space 16*a*, the valve member 15, and the radial (first) passage 17 formed in the valve rod support housing 11B. Therefore, it is possible to reduce a reaction force due to cylinder pressure developed at piston compression stroke and simultaneously applied to the recoil starter or the starting motor, thus facilitating engine start operation.

Figure 2:
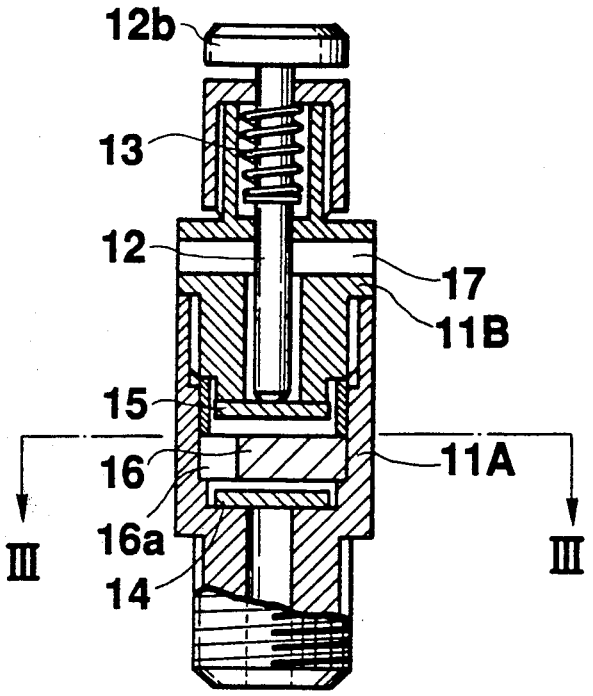
FIG. 2 is a similar cross-sectional view showing the same, which illustrates another state after engine start.

However, once the compressed mixture is ignited within the engine cylinder 1, since an explosion pressure (higher than the compression stroke pressure) is introduced to the accumulator space 16*a* via the check valve member 14, the valve member 15 is closed against the valve spring 13, so that the radial passage 17 is kept closed as shown in FIG. 2. Under these conditions, since the valve member 15 is kept closed by a high explosion pressure introduced into the accumulator space 16*a*, the engine can be operated under the ordinary conditions. Under these conditions, the check valve member 14 is also kept closed by the accumulated pressure.

Further, when the engine is stopped, since the pressure within the accumulator space 16*a* is released through a small gap of the check valve member 14 (since the axial length of the smallest shoulder portion of the main valve housing 11Ais wider than the thickness of the check valve member 14), the accumulator pressure drops, so that the valve member 15 returns by the elastic force of the valve spring 13 to its original position as shown in FIG. 1.

Furthermore, in case the valve member 15 sticks to the valve seat (the lower end surface of the valve rod support housing 11B), it is possible to readily return the valve member 15 to its original open position by pushing the head 12*b* of the valve rod 12 by the hand.

As described above, in the engine start facilitating valve according to the present invention, since pressure developed within the engine cylinder and applied to the recoil starter or the starting motor can be released open at a first engine compression stroke to reduce the compression pressure, it is possible to facilitate engine start. After the engine has been started, since pressure generated within the engine cylinder at explosion stroke and after is accumulated in the accumulator space between the valve member and the check valve member to keep the valve closed against the elastic force of the valve spring, the engine can be operated under the ordinary conditions. At engine halt, the accumulated pressure is released through the check valve member and the valve member.

Further, in case the valve member sticks to the valve seat by foreign matters such as lubricant, carbon, etc., it is possible to easily return the valve member to its normal open position by simply pushing the head of the valve rod by the hand.

Further, since no elastic spring member is used for the check valve member contacting with a high temperature gas, it is possible to prevent the malfunction of the check valve member due to a weak spring member annealed by heat. Furthermore, since the check valve member is not of piston type, it is possible to prevent the malfunction of the check valve member due to carbon accumulation.

What is claimed is:

1. An engine start facilitating valve, comprising:

(a) a valve housing attached to the engine;

(b) spacer member disposed within said valve housing and formed with at least one accumulator space for accumulating engine explosion pressure;

(c) a check valve member disposed within said valve housing, for opening/closing communication between an engine combustion chamber and the accumulator space;

(d) a valve member disposed within said valve housing, for opening/closing communication between the accumulator space and atmospheric pressure;

(e) a valve rod for elastically urging said valve member to open condition by a valve spring, at engine compression stroke cylinder pressure being released to atmospheric pressure through said opened check valve member and said opened valve member, at engine explosion stroke and after, cylinder pressure being accumulated in the accumulator space to close said valve member against the valve spring, at engine halt accumulated pressure being released through both said check valve member and said valve member.

2. A valve for facilitating start of a two-cycle engine formed with an engine cylinder including a combustion chamber, comprising:

(a) a valve housing attached to the engine cylinder and formed with a first passage communicating with atmospheric pressure, a second passage communicating with the combustion chamber, and a third passage communicating between the first and second passages;

(b) a spacer member fixedly disposed within the second passage of said valve housing and formed with at least one accumulator space for accumulating engine explosion pressure in association with an inner wall of said valve housing;

(c) a check valve member, disposed within the third passage of said valve housing movably relative to said spacer member, for opening/closing communication between the combustion chamber and the accumulator space;

(d) a valve member, movably disposed within the third passage of said valve housing, for opening/-closing communication between the accumulator space and the atmospheric pressure;

(e) a valve spring; and (f) a valve rod for urging said valve member to open condition by said valve spring, at engine compression stroke cylinder compression pressure being released from the combustion chamber to the atmosphere through said check valve member and said valve member opened by said valve spring, at a first engine explosion stroke and after cylinder explosion pressure being accumulated in the accumulator space to close said valve member against said valve spring and said check valve member, at engine halt the accumulated pressure being released through said check valve member and said valve member to the atmosphere.

3. The valve of claim 2, wherein said spacer member is a triangular in shape, three accumulator spaces being formed between three end surfaces of said spacer member and an inner wall of said valve housing.

4. The valve of claim 2, wherein said valve rod is formed with a valve head projecting from said valve housing, in case said valve member sticks to a valve seat, said valve member is readily released open when the valve head is pushed.

5. An internal combustion engine having a started condition in which internal explosions produce a driving force, said engine comprising:

a cylinder;

a piston slidably engaged in said cylinder and defining a compression chamber between one end of said piston and an opposing wall of said cylinder, said piston having a compression stroke in which it moves toward said opposing wall thereby creating a compression pressure in said chamber;

means for injecting a combustible vapor into said compression chamber;

means for igniting the vapor within the combustion chamber thereby creating a combustion pressure in the chamber;

means including a first passage closable by a check valve, a second passage closable by a venting valve biased by a push rod to a normally open condition, and a third passage communicating between the first and second passages, for partially venting the compression pressure from said chamber during a compression stroke prior to engine starting;

means responsive to the combustion pressure for closing the venting valve; and the third passage defining an accumulator means between the venting valve and the check valve responsive to the combustion pressure for maintaining the venting valve in the closed position against the biasing thereof, while the engine is in the started condition.

6. The internal combustion engine of claim 5 further comprising means responsive to cessation of said combustion pressure for restoring said venting valve to said normally open position.

7. The internal combustion engine according to claim 5 wherein the venting valve closing means includes means for exerting the combustion pressure on the venting valve, thereby moving the venting valve to the closed position.

8. A method of operating an internal combustion engine of the type having a cylinder, a piston slidably engaged in said cylinder, a compression chamber defined between one end of said piston and an opposing wall of said cylinder, the piston having a compression stroke in which the piston moves toward the opposing wall to create a compression pressure in the combustion chamber, an ignition system for igniting combustible vapor in the compression chamber to create a combustion pressure within the combustion chamber, and a starting mechanism for reciprocating said piston to start the engine, said method comprising the steps of:

providing a compression pressure vent including a first passage closable by a venting valve biased to a normally open position by a push rod, a second passage closable by a check valve, and a third passage communicating between the first and second passages and closable at opposite ends by said valves to define an accumulator;

operating said starting mechanism thereby creating the compression pressure in said compression chamber during the piston compression stroke;

venting the compression pressure from the combustion chamber through the vent around the check valve and the normally open venting valve;

periodically injecting a combustible vapor into said compression chamber;

starting the engine by periodically igniting the combustible vapor in said compression chamber, thereby periodically creating the combustion pressure in the combustion chamber and closing the venting valve in response to the combustion pressure in the compression chamber; and receiving and retaining combustion gases in the accumulator by closure of the check valve to maintain the venting valve in a continuously closed condition against the biasing thereof in response to the periodic creation of combustion pressure subsequent to starting the engine.

9. The method of claim 8 including:

stopping the engine; and restoring the venting valve to the normally open position in response to an absence of the periodic creation of combustion pressure.

10. The method of claim 8 wherein the step of maintaining the venting valve in a continuously closed condition against the biasing thereof in response to the periodic creation of combustion pressure subsequent to starting the engine includes continuously exerting a pressure substantially equal to the combustion pressure on the venting valve while the engine in is the started condition.

* * * * *